US005916388A

United States Patent [19]

Shiokawa

[11] Patent Number: 5,916,388

[45] Date of Patent: Jun. 29, 1999

[54] METHOD AND APPARATUS FOR THE TREATMENT OF STAINLESS STEEL SURFACES

[75] Inventor: Yoshiro Shiokawa, Tokyo, Japan

[73] Assignee: Anelva Corporation, Tokyo, Japan

[21] Appl. No.: 09/021,131

[22] Filed: Feb. 10, 1998

[30] Foreign Application Priority Data

Mar. 26, 1997 [JP] Japan ..... 9-091606

[51] Int. Cl.[6] ..... C21D 9/67; C21D 1/773

[52] U.S. Cl. ..... 148/596; 148/628; 266/250; 266/103

[58] Field of Search ..... 266/250, 103, 266/108; 148/596, 606, 625, 626, 628

[56] References Cited

FOREIGN PATENT DOCUMENTS

| | | |
|---|---|---|
| 2-85358 | 3/1990 | Japan . |
| 3-285049 | 12/1991 | Japan . |
| 6-41629 | 2/1994 | Japan . |
| 6-116632 | 4/1994 | Japan . |
| 7-60446 | 3/1995 | Japan . |
| 7-233476 | 5/1995 | Japan . |
| 9-217166 | 8/1997 | Japan . |

OTHER PUBLICATIONS

"The Technology of Chromium Oxide passivation on Stainless Steel Surface"; T. Ohmi et al; J. Electrochem. Soc., vol. 140, No. 6, Jun. 1993.

"Correlation of outgassing of stainless steel and aluminum with various surface treatments"; H.F. Dylla et al; J. Vac. Sci. Technol. A11(5), Sep./Oct. 1993.

"Thermal passivation of AISI 316 stainless steel in controlled vacuum"; G. Hulquist and C. Leygraf; J. Vac. Sci. Technol., 17(1), Jan./Feb. 1980.

"Interaction of hydrogen with the surface of type 304 stainless steel"; L.C. Beavis; J. Vac. Sci. Technol., vol. 10, No. 2, Mar./Apr. 1973.

"Effect of surface treatment on the adsorption kinetics of water vapor in a vacuumchamber"; Y. Tuzi et al; Vacuum/ vol. 47/No.6–8, pp. 705 to 708/ 1996.

"Scientific Semiconductor Manufacturing Using Process Gases"; Tadahiro Ohmi; Ultra Clean Technology Vo. 9, No. 5/6, published on Dec. 10, 1997.

*Primary Examiner*—Deborah Yee

*Attorney, Agent, or Firm*—Burns, Doane, Swecker & Mathis, L.L.P.

[57] ABSTRACT

The invention includes an apparatus and associated method of increasing the pump-out efficiency of $H_2O$ by, for example, reducing the staying time or the probability of sticking of $H_2O$ or analogous molecules on a stainless steel surface. The method for the vacuum treatment of stainless steel surfaces includes an annealing treatment carried out under conditions of at least 500° C. while maintaining an $H_2O$ partial pressure of not more than $1\times10^{-5}$ torr, or at least 400° C. while maintaining an $H_2$ partial pressure of at least ten times the $H_2O$ partial pressure, or at least 300° C. while maintaining an $H_2$ partial pressure at least the same as the $H_2O$ partial pressure and activating the $H_2$. Furthermore, during the interval after the annealing treatment and before use, the surface is stored in an environment such that the product of the relative humidity and the number of days is not more than 500. Following the annealing treatment a baking treatment is carried out as required under conditions of $H_2O$ partial pressure not more than $1\times10^{-5}$ torr, or $H_2$ partial pressure at least ten times the $H_2O$ partial pressure, or $H_2$ partial pressure at least the same as the $H_2O$ partial pressure in a state where the reactivity of the $H_2$ is increased. The associated apparatus includes a device capable of sequentially heating the stainless steel surface, such as a plurality of individually controlled wire heaters, a lamp heater with moveable reflector, or a laser oscillator with moveable reflecting mirror. The associated apparatus includes a device for increasing the partial pressure of $H_2$, such as a low-temperature panel that releases $H_2$ when heated, a solid that releases $H_2$ when heated, a controlled turbomolecular pump, or a separate $H_2$ delivery system.

24 Claims, 4 Drawing Sheets

METHOD AND APPARATUS FOR THE TREATMENT OF STAINLESS STEEL SURFACES

This application claims priority under 35 U.S.C §§119 and/or 365 to application Ser. No. 9-091606 filed in Japan on Mar. 26, 1997; the entire content of which is hereby incorporated by reference.

BACKGROUND OF THE INVENTION

Field of the Invention

The invention concerns a method for the vacuum treatment of stainless steel surfaces, vacuum treatment apparatus and vacuum apparatus and, in particular, it concerns a method and apparatus for modifying the surface of stainless steel which is suitable as a vacuum material, and vacuum apparatus which has a construction such that said method for the vacuum treatment of stainless steel surfaces can be carried out efficiently.

Related Art

Stainless steel is a metal which is especially suited for use in a vacuum environment (referred to hereinafter as a "vacuum material"). Stainless steel is used at the present time for most vacuum chambers, parts which are used under vacuum, and gas piping. At the present time SUS304 and SUS316, and the so-called L-materials which have a reduced carbon content, such as 304L and 316L, are being used for this purpose. Vacuum materials other than stainless steels, such as aluminum alloys are also being used as metals for vacuum chambers. Molybdenum is also being used for heat resistance as metals for components inside of vacuum chambers.

It is essential with a vacuum material that the amount of gas which is released from a surface which is exposed to the vacuum should be low. Stainless steel is ideal in this respect in terms of its actual characteristics, but at the present time techniques such as those indicated below are being used for permanently modifying the surface in order to improve effectiveness in this regard.

In general, the porous oxide film which is formed naturally on the surface is removed either mechanically or chemically. Alternatively, a dense oxide film which has the desired characteristics may be formed artificially. If the surface is rough then this alone increases essential surface area and so polishing the surface to a mirror finish may also be carried out as well. Such surface treatments are intended to reduce the amount of gas which is ultimately released when the material is placed under vacuum conditions. The effect of these surface treatments are assessed and evaluated from the viewpoint of the amount of gas which is released.

Alternatively, apart from the above mentioned permanent surface modifications, processes are used to remove gases which are attached to or absorbed by the surface of the vacuum material removed and the surface is cleaned. This process can be carried out under vacuum conditions. A baking treatment is the most general process. Baking releases the gas by means of thermal energy by heating the surface for a period ranging from a few hours to a few tens of hours to a temperature of from 100° C. to 300° C. while pumping out the system. Uniform heating of the whole surface which is exposed to a vacuum during the baking is of great importance. This is because if there is a cold region then the gas which has been released will ultimately concentrate in this cold region. It is known that a heating temperature of 200° C. is adequate for removing gas. In a very few cases the baking temperature is below 200° C., and in very special cases it reaches a maximum of 400° C.

Plasma discharge cleaning is another process. Plasma discharge cleaning may be used instead of aforementioned baking process. For plasma discharge cleaning, a rare gas is introduced at a pressure of up to $10^{-2}$ torr and plasma is generated under vacuum conditions between an anode which has been established inside the vacuum chamber and the vacuum chamber as the cathode. On generating the plasma discharge the ionized rare gas collides with the inner surface of the vacuum material that forms the vacuum chamber with a high energy and the gas which is attached to the inner surface of the chamber is released by means of the sputter phenomenon. There are also cases where $H_2$ (hydrogen gas) is used instead of rare gas in order to change the chemical nature of the gas which is attached to the inner surface of the vessel to one which is more easily removed by means of a chemical reaction along with the sputter phenomenon. The surface of the vacuum chamber may also be heated in order to promote the chemical reaction.

More recently the need not just for a reduction in the amount of gas which is released by also for more efficient pump out has been recognized. However, it is very difficult to measure the "staying time" and the "sticking probability" of molecules to the vacuum material surfaces which determine pump out efficiency and so it has been impossible to evaluate the effect of surface treatments. The staying time, the sticking probability, and their effect on efficiency of pump out are described in detail below.

Heat treatment techniques which modify the characteristics of stainless steel as a solid are known as surface improvement techniques. This generally involves transforming the material into a uniform austenite phase by heating the stainless steel to about 1050° C. Such heat treatment is generally carried out in air, but in this case a thick black oxide layer is formed on the surface. In those cases where the heat treatment is carried out in the final stages after working the parts, a hydrogen oven or a vacuum oven is used to prevent the formation of this oxide layer. In a hydrogen oven there are no closed chamber walls like those of vacuum apparatus but $H_2$ is introduced into the oven and generally $H_2$ is discharged out of the oven and so the material is heated in a $H_2$ atmosphere at atmospheric pressure. In a vacuum oven the material is heated under vacuum conditions. In either case, the objective in preventing the formation of a visible oxide film can be achieved satisfactorily even though pressure checks of the heating atmosphere are not carried out. There is no particular way in which the material is stored after heat treatment. This is because a passive or equilibrium state is achieved within the stainless steel and corrosion does not proceed so that there is no change in the overall characteristics of the stainless steel as a solid. Hence, there is no problem at all even if the material is stored for a prolonged period of time under, for example, conditions of high humidity.

Problems Addressed by the Invention $H_2O$ (water) is the main component of the residual gas when the baking as described above has not been carried out. The $H_2O$ partial pressure falls slowly with pumping out but, with no baking, $H_2O$ often forms the main component even after pumping out for a period of time ranging from a few weeks to a few months. Even in those cases where baking is carried out and the pressure of $H_2O$ is reduced, $H_2O$ is released in large quantities when energy is applied to the surface in the form of a beam or plasma. While the above mentioned "staying time" of $H_2O$ on the metal is 104 seconds, the flying time in the space in a vacuum is $10^{-3}$ seconds. Thus, if the probability of sticking is 1 then an amount of $H_2O$ some 107 times the amount which is present in the space will be hidden on the metal surface. A large amount of $H_2O$ is therefore released with little excitation. $H_2O$ is the gas which causes most problems with many kinds of vacuum apparatus. This becomes very serious, particularly in a system which has not been baked and where some energy is being imparted to the material surface. For example, the plasma temperature is reduced by $H_2O$ in nuclear fusion apparatus, and $H_2O$ becomes a film impurity in the plasma deposition apparatus.

A very long time is required to pump out the $H_2O$ not because there is a large quantity of $H_2O$ attached to the surface but because it cannot be pumped out efficiently. In a vacuum (more precisely, in a vacuum of the molecular flow region) the gas proceeds in a straight line and collides with a wall where some rebounds as it strikes the wall but some sticks to the wall and is released again only after a certain "staying time". This process is repeated many times and then, by chance, the gas flies into the pumping port and is pumped out. If the ratio of the area of the vacuum walls and the area of the pumping port in general vacuum apparatus is large, for example 10 to 1, then the gas will collide with the walls some ten times before flying into the pumping port. Since the staying time is long on each occasion, the pump out efficiency is very poor.

The rate at which gas that collides with the surface becomes attached to the surface is called the "probability of sticking". The value of the probability of sticking also has an effect on the pumping out time in just the same way as the staying time mentioned above. In the case of $H_2O$ the staying time is 104 seconds and so if it is assumed that the $H_2O$ which collides with the wall is always attached to the wall (a probability of sticking of 1) then 105 seconds is required to pump out a certain $H_2O$ molecule if the ratio of the area of the vacuum walls to the area of the pumping area is 10 to 1. However, if it is assumed that only $10^{-5}$ of the water molecules which collide with the wall become attached to the wall (a probability of sticking of $10^{-5}$) then the time required to pump out a certain $H_2O$ molecule becomes 1 second. Thus, the time required for pumping out is proportional to the probability of sticking.

As indicated above, the pump out efficiency is very low when pumping out $H_2O$ from a vacuum chamber which is made of stainless steel, which is effective as a vacuum material, because of the staying time and probability of sticking of the $H_2O$.

OBJECTS AND SUMMARY OF THE INVENTION

A purpose of the present invention is to provide a method for the surface treatment of stainless steel, and an apparatus for the surface treatment of stainless steel, with which the pump out efficiency for $H_2O$ and similar gas molecules is increased by reducing the staying time and/or the probability of sticking of $H_2O$ or similar gaseous molecules to the surface of the stainless steel.

Another purpose of the invention is to provide a vacuum apparatus which is furnished with parts with which the method for the surface treatment of stainless steel can be carried out.

Another purpose of the invention is to provide a method for the vacuum treatment of stainless steel surfaces and vacuum treatment apparatus with which, by contrast, the staying time and/or the sticking probability is increased using the general principle of this invention.

In order to realize the aforementioned objectives, a method for the vacuum treatment of a stainless steel surface in accordance with the present invention is set forth below.

An annealing treatment for reducing the probability of sticking to the stainless steel surface is carried out under conditions of (1) at least 500° C. while maintaining an $H_2O$ partial pressure of not more than $1\times10^{-5}$ torr, or (2) at least 400° C. while maintaining an $H_2$ partial pressure of at least ten times the $H_2O$ partial pressure, or (3) at least 300° C. while maintaining an $H_2$ partial pressure at least the same as the $H_2O$ partial pressure and the $H_2$ is activated. The annealing treatment can be carried out using a hydrogen oven. The annealing treatment may be carried out sequentially. The annealing treatment may last approximately 10 minutes.

The method of vacuum treatment may involve storage after carrying out the first annealing treatment until it is used in an environment such that the product of the relative humidity and the number of days is not more than 500 (RH %×number of days).

The method of vacuum treatment may also involve carrying out a baking treatment while preventing activation of the stainless steel surface. The baking treatment is carried out at a temperature of at least 100° C. under conditions of (1) $H_2O$ partial pressure not more than $1\times10^{-5}$ torr, or (2) $H_2$ partial pressure at least ten times the $H_2O$ partial pressure, or (3) an $H_2$ partial pressure at least the same as the $H_2O$ partial pressure in a state where the reactivity of the $H_2$ is increased. The baking treatment can last from a few hours to a few tens of hours.

In the preceding description, suppression of the activation of the stainless steel surface has been described but, conversely, there are cases where activation of the metal surface is an advantage. In the present invention, by increasing the probability of sticking and fixing the gas on the metal surface, the flow of gas is impeded and fluctuations in gas flow are reduced. This effect can be used, for example, in stabilizing filter applications. With this objective in mind, another method of vacuum treatment according to the invention also involves carrying out a baking treatment at a temperature of at least 100 C. on the above mentioned stainless steel surface where the $H_2O$ partial pressure is at least $1\times10^{-5}$ torr and the $H_2$ partial pressure is not more than the same as the $H_2O$ partial pressure for realizing the aim other than that described above. This baking treatment is characterized by the fact that the activity of the aforementioned stainless steel surface is increased.

DETAILED DESCRIPTION OF THE PREFERRED EMBODIMENTS

Figure 1:
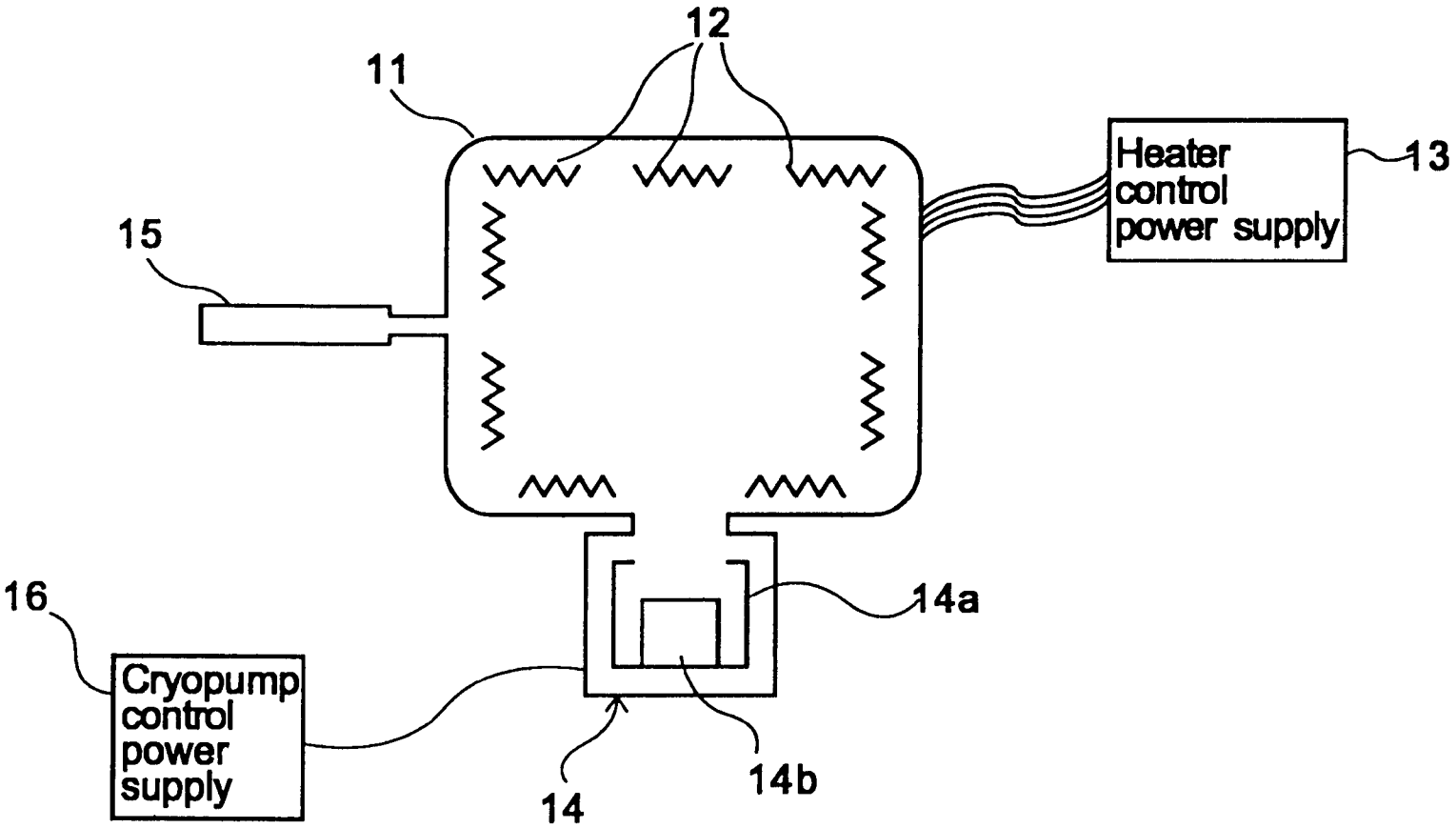
FIG. 1 is a schematic illustration of a first embodiment of the invention.

The general principles of the methods for the vacuum treatment of a stainless steel surface in accordance with the present invention as described above are described below.

In the past, measurement of the probability of sticking of $H_2O$ has been difficult and it has hardly ever been carried out. This is because with the usual methods of measuring pressure in which the average density in a space is measured and with a staying time of $H_2O$ on the metal surface of 104 seconds at room temperature the effect of the vacuum wall predominates and the background is pronounced. The inventors have made it possible to measure the probability of sticking of $H_2O$ on stainless steel surfaces which have been subjected to various vacuum treatments by using a novel method of measurement known as the molecular beam method with which the effect of the vacuum wall can be eliminated.

The method of measuring the probability of sticking of $H_2O$ is described below.

In the above mentioned molecular beam method, three chambers, namely a reaction chamber which is furnished with a sample, heater and gas dozer, a detection chamber which is furnished with a quadrapole mass spectrometer, and an intermediate chamber, are subjected to differential pump out with individually established pumps. The quadrapole mass spectrometer in the detection chamber is arranged in such a way that the sample surface in the reaction chamber is in line of sight through a two-stage collimator. The quadrapole mass spectrometer detects just the gas (neutral molecules) which has been released from the sample surface as a molecular beam. The gas which has rebounded or been released from the vacuum wall in the reaction chamber is pumped out differentially and is virtually undetected and so it can be disregarded. In this case the flux density of the molecular beam is measured. The rate of release of gas from the sample surface can be obtained directly from this. Using the molecular beam method it is possible to estimate the probability of sticking and the staying time, for example, of an active gas on the sample surface.

The probability of sticking of $H_2O$ can be measured with a high level of accuracy in this way. First of all, $H_2O$ is radiated onto an SUS surface as a sample, the reflected $H_2O$ is measured and the doze rate is obtained. Subsequently, the sample is heated after a time which is sufficiently short when compared with the staying time, the $H_2O$ which remains on the sample surface is removed and the amount of absorption is obtained under the same conditions as when the amount of doze was being obtained. The respective measured amounts are in arbitrary units, but the ratio of these values (=amount of absorption/doze rate) represents the absolute value of the amount of sticking probability although the ratio depends on the amount of doze, the following measurements were carried out at 0.5 Langmuir (0.5×10−6 torr×sec.) of doze.

A vacuum apparatus or vacuum treatment apparatus for carrying out the method of the present invention is constructed in the following way in order to achieve the above mentioned objectives. In each of the descriptions that follow, the vacuum apparatus has a stainless steel vacuum chamber and is furnished with means for treating the stainless steel surfaces of the vacuum chamber. The vacuum treatment apparatus is an apparatus in which stainless steel parts can be located within a vacuum chamber and the vacuum treatment apparatus is provided with means for treating the surfaces of the stainless steel parts.

The vacuum apparatus or vacuum treatment apparatus can be provided with means for carrying out an annealing treatment, which reduces the probability of sticking on the stainless steel surfaces. The annealing treatment may be carried out under conditions of at least 500° C. while maintaining an $H_2O$ partial pressure of not more than $1\times10^{-5}$ torr, or at least 400° C. while maintaining an $H_2$ partial pressure of at least ten times the $H_2O$ partial pressure, or at least 300° C. with a $H_2$ partial pressure at least the same as the $H_2O$ partial pressure and activation of the $H_2$. The means for carrying out the annealing treatment can be constructed in such a way that the stainless steel surfaces are annealed sequentially.

The vacuum apparatus or vacuum treatment apparatus can have means for carrying out a baking treatment at a temperature of at least 100° C., while suppressing activation of the stainless steel surface, under conditions of $H_2O$ partial pressure not more than $1\times10^{-5}$ torr, or an $H_2$ partial pressure at least ten times the $H_2O$ partial pressure, or an $H_2$ partial pressure at least the same as the $H_2O$ partial pressure in a state where the reactivity of the $H_2$ has been increased.

The vacuum apparatus or vacuum treatment apparatus can have means for carrying out a baking treatment of the aforementioned stainless steel surfaces that is carried out at an $H_2O$ partial pressure of at least $1\times10^{-5}$ torr and with the $H_2$ partial pressure the same as, or below, the $H_2O$ partial pressure, and the activation of the aforementioned stainless steel surface is increased.

The vacuum apparatus or vacuum treatment apparatus described above may include an $H_2$ partial pressure increasing part in which $H_2$ which has been adsorbed on a very low temperature panel is released by raising the temperature.

The vacuum apparatus or vacuum treatment apparatus described above may include an $H_2$ partial pressure increasing part in which $H_2$ which has been occluded in a solid is released by heating.

The vacuum apparatus or vacuum treatment apparatus described above may include an $H_2$ partial pressure increasing part in which the exhaust side pressure of the turbo molecular pump is controlled and the $H_2$ partial pressure is increased by causing $H_2$ to back-diffuse through said turbo molecular pump.

A schematic drawing of a first embodiment of the invention is shown in FIG. 1. The apparatus shown in FIG. 1 is vacuum apparatus which is furnished with a stainless steel vacuum chamber 11 and it is furnished with apparatus parts or means with which the stainless steel surfaces of said vacuum chamber are treated. Tungsten (W) wire heaters 12 are arranged along the inner surface of the vacuum chamber 11. Power is supplied from a heater control power supply 13 to each of the W wire heaters 12. A cryopump 14 comprising a low temperature panel 14*a* and a very low temperature panel 14*b*, and a partial pressure gauge 15, are fitted to the vacuum chamber 11. The cryopump 14 is furnished with a cryopump control power supply 16.

The W wire heaters 12 are arranged close to the inner surfaces of the vacuum chamber 11 and can achieve a temperature of at least 1300° C. The W wire heaters 12 are divided electrically into 10 heaters. The heater control power supply 13 can heat each of the W wire heaters 12 individually. The partial pressure gauge 15 is a residual gas mass spectrometer and it monitors the partial pressures under vacuum conditions.

The low temperature panel 14*a* of the cryopump 14 is cooled to about 80K and pumps out the $H_2O$ which has a high vapor pressure. The very low temperature panel 14*b* of the cryopump 14 is generally cooled to about 13K and pumps out the $H_2$, $N_2$ and CO which have a low vapor pressure. In this embodiment the temperature of the very low temperature panel 14*b* can be set to any temperature within the range from 13 to 30K by operating the cryopump control power supply 16. Although $N_2$ and CO are generally pumped out in this temperature range, the ability to pump out $H_2$, which has an especially low vapor, pressure falls suddenly. In this way it is possible to increase just the partial pressure of $H_2$ within the vacuum chamber 11 by operating the cryopump control power supply 16.

Deactivation of the surface of the stainless steel vacuum chamber 11 is achieved in the way described below.

The interior of the vacuum chamber 11 is pumped out by operating the cryopump 14 in the usual way and then the cryopump control power supply 16 is operated while checking the partial pressures within the chamber with the partial pressure gauge 15 so as to set the $H_2$ partial pressure higher than the $H_2O$ partial pressure. In this state, just one of the W wire heaters 12 is heated by the heater control power supply 13 and the stainless steel surface in the vicinity of the heater is annealed at a temperature of at least 300° C. The partial pressures are also verified with the partial pressure gauge 15 at this time and a state where the $H_2$ partial pressure is greater than the $H_2O$ partial pressure is maintained. After completing the anneal in one location in about 10 minutes, for example, the remaining W wire heaters 12 are heated successively in the same way until ultimately the whole of the stainless steel vacuum chamber 11 has been annealed.

When the temperature is raised for annealing in the way described above, the $H_2O$ which is attached to the stainless steel surface of the vacuum chamber 11 is released and the $H_2O$ partial pressure rises. However, in this embodiment, the W wire heaters 12 are separate and the construction is such that just a part of the overall surface can be annealed. The rise in the $H_2O$ partial pressure is very small when compared with annealing where the entire vacuum chamber 11 is annealed at the same time. For the same reason the power consumed by the heater control power supply 13 is also low. Such a method where partial annealing is carried sequentially is effective because the parts which have been deactivated by annealing do not change their state unless they are heated and the $H_2O$ partial pressure is increased.

The method in which $H_2$ gas is stored in a cylinder and delivered to the vacuum chamber from an outside source is the usual method of increasing the $H_2$ partial pressure, but in this case steps must be taken to prevent gas leakage from the cylinder and the pipework. Safety is a particular problem since in many cases baking is carried out over a long period of time in the absence of people. On the other hand, no fresh $H_2$ is delivered to the vacuum chamber from a separate source with the method of this embodiment, the $H_2$ which has been collected in the cryopump 14 being converted to gas and released, and so the level of safety is excellent.

When $H_2$ comes into contact with a W surface at a temperature above 1300° C. it forms $H_2$-activated species which have greatly increased reactivity. In this embodiment the surface of the W wire heaters 12 has a temperature of at least 1300° C. so they also have a role in increasing the reactivity of the $H_2$.

Therefore, the stainless steel surface which is being annealed is also being bombarded with $H_2$ activated species which have been generated with the adjacent W wire heaters 12 and deactivation can be achieved efficiently even at an annealing temperature of 300° C.

Deactivation of the inside surface of the stainless steel vacuum chamber 11 is achieved by the above mentioned annealing treatment, and the probability of sticking of $H_2O$ is reduced. Consequently, any $H_2O$ which is released temporarily into the space rebounds with hardly any attachment on colliding with the vacuum chamber 11 and so it can be pumped out efficiently. Some 104 seconds are required to release any $H_2O$ which has collided with, and becomes attached to, the vacuum chamber 11. It is necessary to promote release from the wall and clean the surface to obtain a better pumped out state. For this purpose a baking treatment at a temperature of at least 100° C. is required. However, it is clear that if baking is carried out here without care then the probability of sticking which has been reduced with considerable effort will inevitably be increased again.

The stainless steel surface of the vacuum chamber 11 can be cleaned while keeping said surface deactivated by baking in the way described below. In the same way as when annealing, the $H_2$ partial pressure is set to be higher than the $H_2O$ partial pressure. Each of the W wire heaters 12 is then heated repeatedly in sequence for a short period of some 10 seconds and the whole of the stainless steel vacuum chamber 11 is heated uniformly to at least 100° C. The baking treatment is usually continued for a period of time ranging from a few hours to a few tens of hours, and the $H_2$ partial pressure is generally set to be higher than the $H_2O$ partial pressure until said baking has been completed and the vacuum chamber 11 has cooled to below 100° C. If the $H_2$ partial pressure is higher than the $H_2O$ partial pressure and $H_2$ activated species are being generated by the W wire heaters 12, then the stainless steel surface of the vacuum chamber 11 can be cleaned while keeping said surface deactivated.

Figure 2:
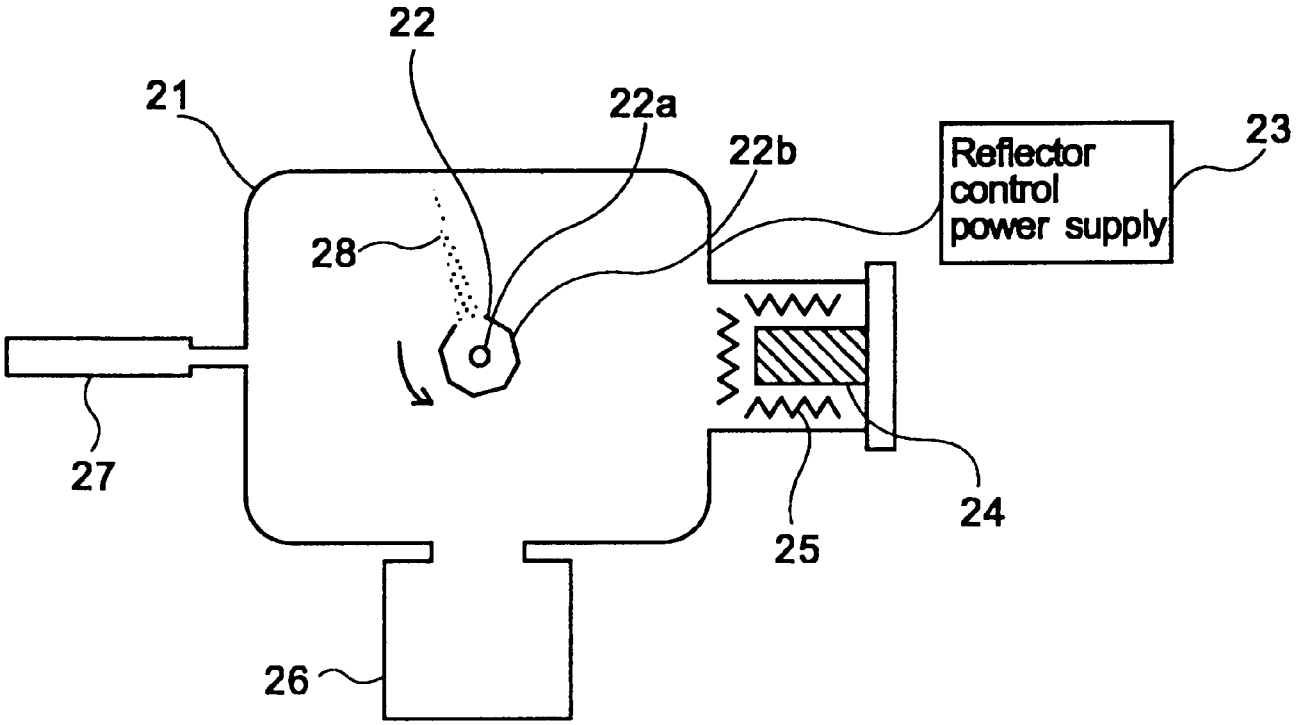
FIG. 2 is a schematic illustration of a second embodiment of the invention.

A schematic drawing of a second embodiment of the invention is shown in FIG. 2. The apparatus shown in FIG. 2 is a vacuum apparatus which has a stainless steel vacuum chamber 21, and it is furnished with apparatus parts or means with which the stainless steel surface of said vacuum chamber is treated. A halogen lamp heater 22, comprising a halogen lamp 22*a* and a reflector 22*b*, is arranged inside the stainless steel vacuum chamber 21. The reflector 22*b* can be rotated freely. A reflector control power supply 23, a bulk getter element 24, W wire filaments 25, an evacuation pump 26 and a partial pressure gauge 27 are established in the vacuum chamber 21.

The halogen lamp heater 22 is located close to the middle of the internal space of the vacuum chamber 21 so as to be in line of sight of virtually all of the inner wall surfaces of the vacuum chamber 21. The reflector 22*b* can be rotated around the halogen lamp 22*a* and infrared radiation 28 from the halogen lamp 22*a* can be reflected, focused and irradiated onto any location on the inner wall surface of the vacuum chamber by operating the reflector control power supply 23. The bulk getter element 24 is an Zr-Al alloy which can occlude hydrogen gas in large quantities, and when it is heated the occluded $H_2$ gas is released. The W wire filaments 25 are arranged so as to surround the bulk getter element 24, and the W surface can be heated to at least 1300° C. The pump 26 can generally be of any type. The partial pressure gauge 27 is used to check the partial pressures.

The stainless steel surface on the inside of the vacuum chamber 21 is deactivated in the way described below. The interior of the vacuum chamber 21 is pumped out with the pump 26 and then, while checking the partial pressure gage 27, the bulk getter element 24 is heated and $H_2$ is released in such a way that the $H_2$ partial pressure is set higher than the $H_2O$ partial pressure. The W wire filaments 25 are switched on and the W surface is set to at least 1300° C. Infrared radiation 28 is reflected onto just a certain small region of the inside surface of the vacuum chamber 21 by operating the reflector control power supply 23 and this region is annealed at a temperature of at least 300° C. while maintaining the conditions described above. The reflector 21*b* is then rotated by operating the reflector control power supply 23 and the region which is being annealed is moved sequentially, and ultimately the whole of the stainless steel vacuum chamber 21 is annealed in the same way. The $H_2$ which is released from the bulk getter element 24 comes into contact with the high temperature W surface of the W wire filaments 25 which surround the getter and $H_2$ active species are produced. The $H_2$ active species collide with the stainless steel surface which is being annealed and deactivation is achieved efficiently as a result even at 300° C.

Next, the stainless steel surface inside the vacuum chamber 21 is cleaned while maintaining the deactivated state. Here the $H_2$ partial pressure is higher than the $H_2O$ partial pressure and the W surface is above 1300° C. as when annealing. While maintaining this state, the reflector 21*b* is rotated quickly by operating the reflector control power supply 23 and the whole of the stainless steel vacuum chamber 21 is baked at a temperature of at least 100 C. more or less uniformly. The $H_2$ partial pressure and the W surface temperature are maintained as they are until the baking has been completed and the stainless steel vacuum chamber 21 has cooled to below 100° C.

Figure 3:
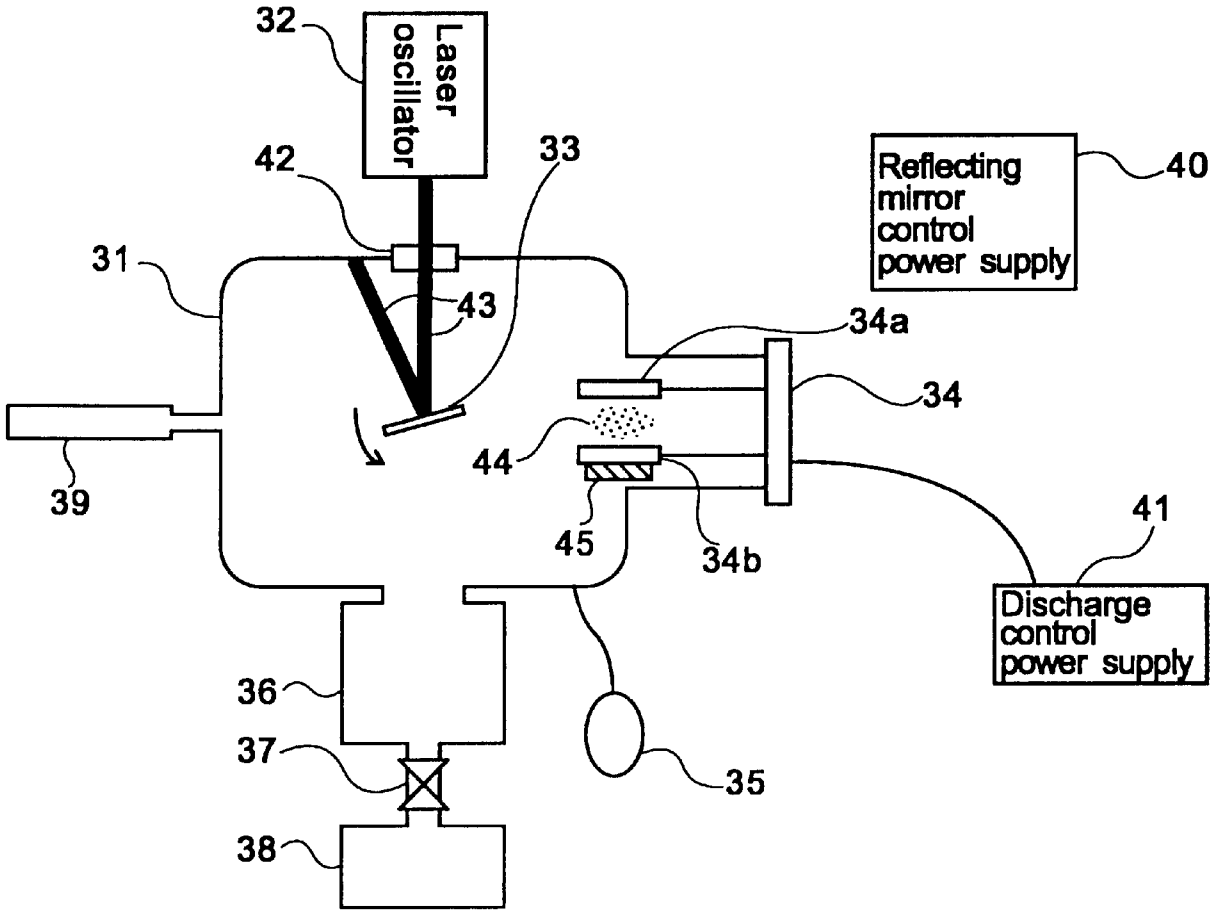
FIG. 3 is a schematic illustration of a third embodiment of the invention.

A schematic drawing of a third embodiment of the invention is shown in FIG. 3. The apparatus shown in FIG. 3 is again a vacuum apparatus which is furnished with a stainless steel vacuum chamber 31, and it is furnished with apparatus parts or means with which the stainless steel surface of said vacuum chamber are treated. A laser oscillator 32, a freely rotatable reflecting mirror 33, a pair of discharge electrodes 34 comprising an anode 34*a* and a cathode 34*b*, a rare gas delivery system 35, a pumping system comprising a turbomolecular pump 36, a very low flow rate valve 37 and a rotary pump 38, and a differential pressure gauge 39 are established in the stainless steel vacuum chamber 31. Moreover, a reflecting mirror control power supply 40 is established for the reflecting mirror 33 and a discharge control power supply 41 is established for the pair of discharge electrodes 34. A glass window 42 for laser transmission is formed in part of the vacuum chamber 31.

Laser radiation 43 from the laser oscillator 32 passes through the glass window 42 and is directed onto the reflecting mirror 33. The reflecting mirror 33 can be rotated and the laser radiation 43 can be directed onto any position on the inner wall surface of the vacuum chamber 31 by operating the reflecting mirror control power supply 40. The pair of discharge electrodes 34 generate a plasma discharge by applying a high voltage across the anode 34*a* and the cathode 34*b* with the discharge control power supply 41. A magnet 45 is fitted to the back of the cathode 34*b*. A so-called magnetron discharge is achieved and the discharge can be maintained even at a pressure of $10^{-3}$ torr. The partial pressure gauge 39 is used to check the partial pressures. The rare gas delivery system 35 can deliver rare gas into the vacuum chamber 31 to about $10^{-3}$ torr.

The turbomolecular pump 36 is of the composite type, and a screw groove pump is assembled with the rotor blades on the after-side (exhaust side), and the tolerable exhaust side pressure is of the order of 10 torr. The rotary pump 38 is an ordinary one. The very low flow rate valve 37 can be varied in terms of conductance within the range from about $10^{-4}$ torr l/s to about 10 torr l/s. The compression ratio which represents the magnitude of the back-diffusion from the exhaust side to the intake side of the turbomolecular pump 36 depends greatly on the molecular weight of the gas, and it is about 103 for $H_2$ but about 106 for $H_2O$. If the exhaust side pressure is the same at 1 torr then the partial pressure on the intake side due to back-diffusion is $1\times10^{-3}$ torr for $H_2$ while it is $1\times10^{-6}$ torr for $H_2O$. The very low flow rate valve 37 is fully open for normal pump out, but if it is closed a little and the conductance is reduced then the exhaust side pressure of the turbomolecular pump 36 is increased. As a result, the $H_2O$ partial pressure remains low in the stainless steel vacuum chamber 31 while the $H_2$ partial pressure is increased by back-diffusion. The $H_2$ partial pressure can be set higher than the $H_2O$ partial pressure in this way. The maximum $H_2$ partial pressure which can be achieved in this way is $1\times10^{-2}$ torr which is the value obtained by dividing the tolerable exhaust side pressure of the turbomolecular pump 36 by the $H_2$ compression ratio, and this is satisfactory.

The surface of the stainless steel vacuum chamber 31 is deactivated in the way described below. The very low flow rate valve 37 is closed a little while checking the partial pressure gauge 39 and set so that the $H_2$ partial pressure is higher than the $H_2O$ partial pressure. Rare gas is delivered from the rare gas delivery system 35 until the pressure reaches $10^{-3}$ torr, the discharge control power supply 41 is operated and a plasma discharge 44 is generated by the pair of discharge electrodes 34. While maintaining this state, the reflecting mirror 33 is rotated by operating the reflecting mirror control power supply 40 and the laser radiation 43 is directed onto just a certain small region of the stainless steel vacuum chamber 31 and this is annealed at a temperature of at least 300° C. The region which is being annealed is moved sequentially by rotating the reflecting mirror 33 by operating the reflecting mirror control power supply 40, and ultimately the whole of the stainless steel vacuum chamber 31 is annealed.

It is well known that $H_2$ is formed into activated $H_2$ species which have a high reactivity on passing through a plasma. The stainless steel surface of the vacuum chamber 31 which is being annealed is bombarded with the $H_2$ active species which have been generated by the plasma 44, and deactivation can be achieved efficiently even at an annealing temperature of 300° C.

Next, the stainless steel surface of the vacuum chamber 31 is cleaned while maintaining the deactivation. As with annealing, the $H_2$ partial pressure is set higher than the $H_2O$ partial pressure and a plasma discharge is produced at an overall pressure of $10^{-3}$ torr. While maintaining this state, the reflecting mirror 33 is rotated rapidly by means of the reflecting mirror control power supply 40 and the whole of the stainless steel vacuum chamber 31 is baked at a temperature of at least 100 C. more or less uniformly. Generally, the $H_2$ partial pressure is kept higher than the $H_2O$ partial pressure and the plasma discharge is continued until the baking has been completed and the vacuum chamber 31 has cooled to below 100° C.

In this embodiment the plasma discharge is maintained during the baking, and this state is analogous to the plasma discharge cleaning with $H_2$ which is carried out in the course of conventional baking. However, unlike conventional cleaning or baking the ions do not collide with the surface at high energy. Furthermore, the $H_2O$ partial pressure is maintained higher than the $H_2O$ partial pressure from the start to the finish of baking in order to keep the surface in a deactivated state.

Figure 4:
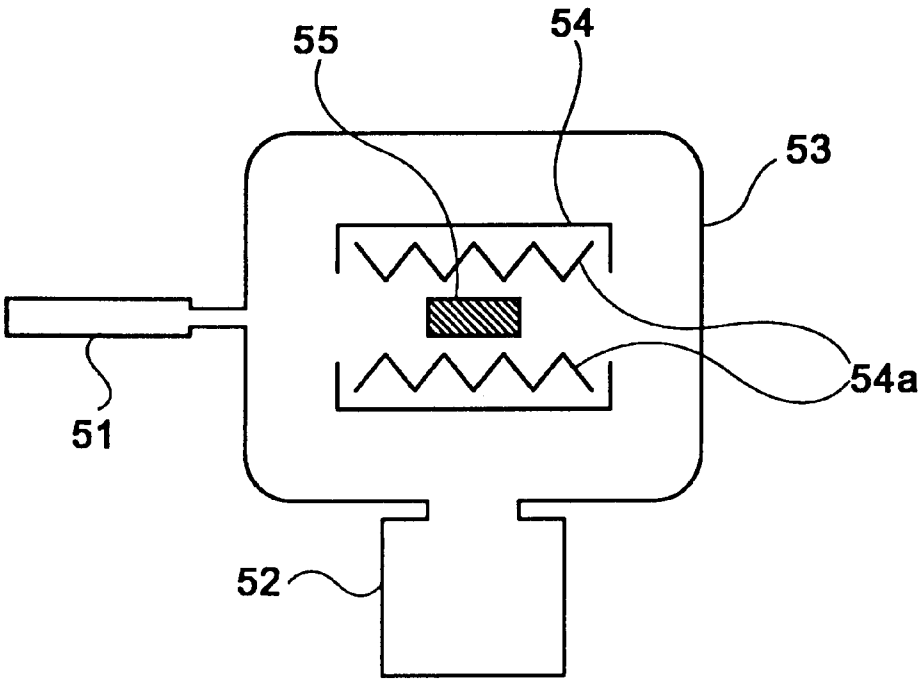
FIG. 4 is a schematic illustration of a fourth embodiment of the invention.

A schematic drawing of a fourth embodiment of the invention is shown in FIG. 4. The apparatus shown in FIG. 4 is an apparatus with which the surfaces of stainless steel parts are treated. A heating oven 54 is arranged in a vacuum chamber 53 which is furnished with a partial pressure gauge 51 and an evacuation pump 52. The stainless steel part 55 is arranged inside said heating oven 54. The heating oven 54 is provided with a heater 54*a* for heating purposes. The stainless steel part 55 is a part which is to be used in another vacuum apparatus. The heating oven 54 is pumped out by means of a pump 52 which is established in the vacuum chamber 53 and the stainless steel part 55 is heated under vacuum conditions. The partial pressure gauge 51 is used to check the partial pressures.

The surface of the stainless steel part 55 is deactivated in the way described below. The vacuum chamber 53 is pumped out to a vacuum with the pump 52 and the $H_2O$ partial pressure is set to be not more than $1\times10^{-5}$ torr using the partial pressure gauge 51. The stainless steel part 55 is then annealed at 500° C. in the heating oven 54 while maintaining these conditions.

As described earlier the surface of the stainless steel part 55 is stored in an environment of not more than 500 (RH %×number of days) before it is used in practice. Here, "RH %×number of days" represents the product of the relative humidity (RH %) and the number of days (days).

When the above mentioned stainless steel part 55 is treated in a vacuum apparatus the heating is carried out in a state where the $H_2O$ partial pressure is not more than $1\times10^{-5}$ torr, or where the $H_2$ partial pressure is at least ten times the $H_2O$ partial pressure.

In this embodiment there is no specific means of increasing the $H_2$ partial pressure or means of increasing the reactivity of the $H_2$ as described in the earlier embodiments. However, the part which is being annealed is very small when compared with the vacuum chamber and so the $H_2O$ partial pressure can be maintained below $1\times10^{-5}$ torr and the annealing temperature can be raised to 600° C. easily. A means of increasing the $H_2$ partial pressure and or a means of increasing the reactivity of $H_2$ as used in each of the embodiments described earlier could also be provided in this embodiment.

Both annealing and baking were carried out in the above mentioned first, second and third embodiments described earlier, but either one of these vacuum treatments may be carried out. That is to say, these embodiments could be used as they are for just annealing with or without baking. In this case no surface cleaning is carried out, but the probability of sticking has a low value and so pump-out can be carried out efficiently. Just baking may be carried out without annealing. In this case the surface is cleaned without further increasing the probability of sticking (an initial value of about $1\times10^{-2}$ is common).

In the first, second and third embodiments described above the $H_2$ partial pressure is higher than the $H_2O$ partial pressure and $H_2$ active species are generated, but the $H_2$ partial pressure can just be increased to at least ten times the $H_2O$ partial pressure without generating an $H_2$ active species. Alternatively, the $H_2O$ partial pressure may just be set to below $1\times10^{-5}$ torr. However, the required annealing temperature is 400° C. when the $H_2$ partial pressure is just set higher than the $H_2O$ partial pressure without generating an $H_2$ active species, and 500° C. when the $H_2O$ partial pressure is just set to below than $1\times10^{-5}$ torr.

Heating can be accomplished in ways other than those disclosed in the above embodiments. The $H_2$ partial pressure can be raised using other methods. Moreover, the reactivity of the $H_2$ can also be increased using other methods.

A method and apparatus for rendering stainless steel surfaces which are effective for vacuum material materials inactive have been described above, but of course the surface of the same metals can also be activated by reversing the vacuum treatments described above.

As described above, by means of the present invention it is possible to reduce the staying time or the probability of sticking of $H_2O$ or analogous gas molecules (including general particles) on a stainless steel surface. The present invention therefore enables the efficiency with which $H_2$ or similar gas molecules can be pumped out to be improved.

The following new findings have been discovered with novel means of measuring the probability of sticking of $H_2O$ on a stainless steel surface.

The probability of sticking changed considerably with the various vacuum treatments. The probability of sticking of $H_2O$ on a stainless steel surface which had only been polished and cleaned was about $1\times10^{-2}$ . On heating (carrying out an annealing treatment) for a short period of time (some 10 minutes) at a high temperature under vacuum conditions without the pressure of $H_2$ and with a $H_2O$ partial pressure set to not more than $1\times10^{-5}$ torr (lower pressure), the probability of sticking was almost unchanged up to a temperature of 600° C. but, on exceeding 600° C., it fell rapidly, falling to $1\times10^{-3}$ at 650° C. and to $1\times10^{-4}$ at 700° C. These values are all probabilities of sticking in the state where the sample has returned to room temperature after being annealed.

An $H_2O$ partial pressure of not more than $1\times10^{-5}$ torr is required to reduce the probability of sticking by annealing as described above. Conversely, when the $H_2O$ partial pressure is higher than $1\times10^{-5}$ torr (at higher pressure) the probability of sticking inevitably increased. In fact, a large amount of $H_2O$ is attached to a surface which has been exposed to the air and so if such a surface is heated then $H_2O$ is released in large quantities and the $H_2O$ partial pressure inevitably rises. It is not easy to maintain an $H_2O$ partial pressure of not more than $1\times10^{-5}$ torr during an annealing treatment in actual vacuum apparatus.

It has been discovered as a result of investigating methods that the probability of sticking can be reduced by annealing, even when the $H_2O$ partial pressure is high, because the presence of $H_2$ suppresses the adverse effects of $H_2O$.

In practical terms, it has been found that the probability of sticking can be reduced by annealing even if the $H_2O$ partial pressure exceeds $1\times10^{-5}$ provided that the $H_2$ partial pressure is at least the same as the $H_2O$ partial pressure. It has been found that the presence of $H_2$ not only suppresses the adverse effect of $H_2O$ but also further reduces the probability of sticking by annealing. That is to say, it was found that at the same annealing temperature the probability of sticking was reduced further and the temperature at which the probability of sticking started to fall was also reduced when $H_2$ was present.

Moreover, it was clear that the effect of reducing the probability of sticking was further advanced by the active species by measuring the change in the probability of sticking where W wire heaters which had been heated above 1300° C. were established in the vacuum chamber.

The annealing treatment conditions for reducing the probability of sticking of $H_2O$ on a stainless steel surface were estimated as follows in practical terms as a result of making measurements under various conditions as indicated above.

The temperature at which the probability of sticking of $H_2O$ starts to fall is (1) 500° C. when the $H_2O$ partial pressure is not more than $1\times10^{-5}$ torr and the $H_2O$ partial pressure is higher than the $H_2$ partial pressure, (2) 400° C. irrespective of the $H_2O$ partial pressure when the $H_2$ partial pressure is at least 10 times the $H_2O$ partial pressure, or (3)

300° C. when the $H_2$ partial pressure is at least the same as the $H_2O$ partial pressure and $H_2$ active species are being formed.

The baking treatment is described below. Even though the temperature is low, baking involves heating for a prolonged period of time and so it can be thought to have some effect on the sticking probability as well. On investigating the effect of baking it was found that the probability of sticking increased when baking was carried out above 100° C. in a vacuum which had an $H_2O$ partial pressure of at least $1\times10^{-5}$ torr. It was found that the probability of sticking was proportional to the time and the baking temperature over a wide range. For example, on baking for 20 hours at 400° C. at an $H_2O$ partial pressure of $5\times10^{-5}$ torr the probability of sticking actually became $1\times10^{-1}$. However, it was clear that with a surface of which the probability of sticking had been reduced by a single anneal, the probability of sticking increased on baking under the above described conditions.

As in the case of annealing, it was clear that the increase in the probability of sticking was suppressed when $H_2$ gas was introduced and the $H_2$ partial pressure was set high to at least the same as the $H_2O$ partial pressure. Moreover it was clear that the effect of the $H_2$ was enhanced by increasing the reactivity of the $H_2$. It was also confirmed that the effectiveness increased as the $H_2$ pressure was increased and the reactivity of the $H_2$ was increased. It was also observed that the effect due to baking changes according to the initial value of the probability of sticking.

The value for the probability of sticking obtained in the way described above is very stable provided that the material is kept in a vacuum, and it is maintained over a long period of time and is virtually unchanged on exposure to the air for a short period of time. This is so both when it has been reduced by annealing and when it has been increased by baking.

The value of the probability of sticking reduced by annealing gradually increases on being left to stand for a long period of time in air having a relative humidity of 30% at room temperature, increasing by a factor of about 1.5 times in 1 day, by a factor of about 2 times in 10 days and by a factor of about 10 times in 100 days. It is thought that the $H_2O$ in the air reacts with the stainless steel surface and increases the probability of sticking. The extent of the increase can be estimated as being proportional to the product (RH %×number of days) of the relative humidity (RH %) and the number of days (days). Hence, it can be concluded that in order to store a stainless steel surface of which the probability of sticking has been reduced by annealing in such a way that this value is retained it should be stored in an environment of a product of not more than 500 (RH %×number of days). Here, "RH %×number of days" indicates the product of the relative humidity (RH %) and the number of days (days). Thus, if it is stored for 10 days then the relative humidity should be below 50 RH %, and if it is stored for 50 days then the relative humidity should be below 10 RH %. Moreover, when stored under vacuum the requirement is computed using the value obtained on converting the $H_2O$ partial pressure to RH %.

No difference between a surface of which the probability of sticking has been greatly reduced by annealing, and the initial surface can be distinguished on visual examination. Furthermore, there was no segregation of C (carbide) or S (sulfur) revealed by examination with an auger electron spectrum (AES) surface analyzer. When this is considered along with the fact that there is no change in the probability of sticking on exposure to the air for a short period of time, it can be concluded that the mechanism by which the probability of sticking is changed involves a change in the fundamental characteristics of the surface and not the sticking of foreign material to the surface or simple cleaning of the surface.

With regard to the amount of gas released it was known in the past that a short anneal at a high temperature had little effect, and that long term baking was effective and that the effect inevitably disappeared on exposure to the air. An increasing $H_2O$ partial pressure during baking is an effect of gas release and it is not thought that the $H_2O$ partial pressure dominates the surface condition. Rather, a higher $H_2O$ partial pressure during baking indicated the desired release of gasses from the surface. Hence, it is thought that the method and apparatus of this invention as shown in the mode of execution below has a completely different mechanism from those of conventional baking and plasma discharge cleaning, and that the difference in terms of these methods and apparatus is of a fundamental nature.

The shortening of the $H_2O$ pump out time shows the effect described above most clearly, but many other applications can be considered. For example, it is a fact that a film is inevitably deposited in places other than on the substrate on which deposition should occur in vacuum vapor deposition apparatus, and this gives rise to a variety of serious problems. If the substrate is surrounded with a shielding plate that has a surface which has been rendered inactive using the method described above, then it is possible to reduce considerably the extent of deposition in locations other than on the substrate.

Only the preferred embodiments are specifically illustrated and disclosed herein. It should be appreciated that numerous modifications and variations of the present invention are possible in light of the above teachings and within the purview of the appended claims, without departing from the scope and intended spirit of the invention.

What is claimed is:

1. A method for vacuum treatment of a stainless steel surface comprising annealing the surface under one of the following three sets of conditions to thereby reduce the probability of sticking of molecules to the surface:

(a) heating the surface to a temperature of at least 500° C. while maintaining an $H_2O$ partial pressure of not more than $1\times10^{-5}$ torr;

(b) heating the surface to at least 400° C. while maintaining an $H_2$ partial pressure of at least ten times an $H_2O$ partial pressure; and (c) heating the surface to at least 300° C. while maintaining an $H_2$ partial pressure at least the same as an $H_2O$ partial pressure, and activating the $H_2$.

2. The method of claim 1, wherein only a portion of the stainless steel surface is annealed at a time, the annealing treatment being carried out sequentially until the entire surface has been annealed.

3. The method of claim 2, wherein the sequential heating associated with the annealing treatment is provided by one of the following methods:

individually controlling a plurality of wire heaters;

reflecting heat generated by a lamp heater with a moveable reflector; and reflecting heat generated by a laser oscillator with a moveable mirror.

4. The method of claim 1, wherein the annealing treatment has a duration of approximately 10 minutes.

5. The method of claim 1, wherein the $H_2$ partial pressure condition is maintained by one of the following methods:

heating a panel upon which $H_2$ has been absorbed at a very low temperature;

heating a solid in which $H_2$ has been occluded; and adjusting an exhaust-side pressure of a turbo molecular pump in order to create back diffusion of $H_2$ through said turbo molecular pump.

6. The method of claim 1, wherein during a period after carrying out the annealing treatment, the material is stored in an environment where the product of the relative humidity and the number of days stored is not more than 500.

7. The method of claim 1, wherein a baking treatment is carried out subsequent to the annealing treatment thereby removing molecules from the surface without increasing activation of the surface comprising:

baking the surface at a temperature of at least 100° C., while maintaining one of the following pressure conditions:

an $H_2O$ partial pressure not more than $1\times10^{-5}$ torr; an $H_2$ partial pressure at least ten times an $H_2O$ partial pressure; and an $H_2$ partial pressure at least the same as an $H_2O$ partial pressure, and activating the $H_2$.

8. A method for vacuum treatment of a stainless steel surface that removes molecules from the surface without increasing activation of the surface comprising:

baking the surface at a temperature of at least 100° C., while maintaining one of the following pressure conditions:

(a) $H_2O$ partial pressure not more than $1\times10^{-5}$ torr, (b) $H_2$ partial pressure at least ten times an $H_2O$ partial pressure; and (c) $H_2$ partial pressure at least the same as an $H_2O$ partial pressure, and activating the $H_2$.

9. The method of claim 8, wherein the baking treatment lasts from a few hours to a few tens of hours.

10. The method of claim 8, wherein the $H_2$ partial pressure condition is maintained by one of the following methods:

heating a panel upon which $H_2$ has been absorbed at a very low temperature;

heating a solid in which $H_2$ has been occluded; and adjusting an exhaust-side pressure of a turbo molecular pump in order to create back diffusion of $H_2$ through said turbo molecular pump.

11. A method for vacuum treatment of a stainless steel surface that increases activation of the surface comprising:

baking the surface at a temperature of at least 100° C. under conditions comprising:

$H_2O$ partial pressure of at least $1\times10^{-5}$ torr; and an $H_2$ partial pressure not more than the $H_2O$ partial pressure.

12. A vacuum apparatus comprising a stainless steel vacuum chamber and means for carrying out an annealing treatment on the stainless steel that reduces the probability of sticking of molecules to the surface of the stainless steel, the means for carrying out the annealing treatment comprising means for heating and means for establishing a pressure condition within the vacuum chamber, the means for heating and means for establishing a pressure condition are chosen from one of the three following groups:

(a) means for maintaining a temperature of at least 500° C. and means for maintaining an $H_2O$ partial pressure of not more than $1\times10^{-5}$ torr;

(b) means for maintaining a temperature of least 400° C. and means for maintaining an $H_2$ partial pressure of at least ten times an $H_2O$ partial pressure; and (c) means for maintaining a temperature of at least 300° C., means for maintaining an $H_2$ partial pressure at least the same as an $H_2O$ partial pressure, and means for activating the $H_2$.

13. The vacuum apparatus as claimed in claim 12, wherein the means for carrying out the annealing treatment are constructed in such a way that parts of the stainless steel surface are annealed sequentially.

14. The vacuum apparatus of claim 13, wherein the means for heating comprises one of the following:

a plurality of individually controlled wire heaters;

a lamp heater with a moveable reflector; and a laser oscillator with a moveable mirror.

15. The vacuum apparatus of claim 13, wherein the means for establishing a pressure condition comprises one of the following:

(a) a pressure raising part in which $H_2$ which has been absorbed on a very low temperature panel and is released by raising the temperature of the panel;

(b) a pressure raising part in which $H_2$ which has been occluded in a solid and is released by heating; and (c) a pressure raising part in which an exhaust side pressure of a turbomolecular pump is controlled causing $H_2$ to back diffuse through said turbomolecular pump and thereby raise the $H_2$ partial pressure.

16. The vacuum apparatus as claimed in claim 12, further including means for carrying out a baking treatment on the stainless steel that removes molecules from the surface without increasing activation of the surface, the means for carrying out the baking treatment comprising means for heating and means for establishing a pressure condition within the vacuum chamber, the means for heating comprises means for baking the surface at a temperature of at least 100° C.; and the means for establishing a pressure condition comprises one of the following:

(a) means for maintaining an $H_2O$ partial pressure not more than $1\times10^{-5}$ torr;

(b) means for maintaining an $H_2$ partial pressure at least ten times an $H_2O$ partial pressure; and (c) means for maintaining an $H_2$ partial pressure at least the same as an $H_2O$ partial pressure and means for activating the $H_2$.

17. A vacuum apparatus comprising a stainless steel vacuum chamber and means for carrying out a baking treatment on the stainless steel that removes molecules from the surface of the stainless steel without increasing activation of the surface, the means for carrying out the baking treatment comprising means for heating and means for establishing a pressure condition within the vacuum chamber, the means for heating comprises means for baking the surface at a temperature of at least 100° C.; and the means for establishing a pressure condition comprises one of the following:

(a) means for maintaining an $H_2O$ partial pressure not more than $1\times10^{-5}$ torr;

(b) means for maintaining an $H_2$ partial pressure at least ten times an $H_2O$ partial pressure; and (c) means for maintaining an $H_2$ partial pressure at least the same as an $H_2O$ partial pressure and means for activating the $H_2$.

18. The vacuum apparatus of claim 17, wherein the means for establishing a pressure condition comprises one of the following:

a pressure raising part in which $H_2$ which has been absorbed on a very low temperature panel and is released by raising the temperature of the panel, a pressure raising part in which $H_2$ which has been occluded in a solid and is released by heating, and a pressure raising part in which an exhaust side pressure of a turbomolecular pump is controlled causing $H_2$ to back diffuse through said turbomolecular pump and thereby raise the $H_2$ partial pressure.

19. A vacuum apparatus comprising a stainless steel vacuum chamber and means for carrying out a baking treatment on the stainless steel that increases the activation of the surface of the stainless steel, the means for carrying out the baking treatment comprising means for heating and means for establishing a pressure condition within the vacuum chamber, the means for heating comprises means for baking the surface at a temperature of at least 100° C.; and the means for establishing a pressure condition comprises one of the following:

means for maintaining an $H_2O$ partial pressure at least $1\times10^{-5}$ torr, and means for maintaining an $H_2$ partial pressure not more than an $H_2O$ partial pressure.

20. An apparatus for the vacuum treatment of surfaces of stainless steel parts arranged inside a vacuum treatment apparatus, comprising:

means for carrying out an annealing treatment on the stainless steel parts that reduces the probability of sticking of molecules to the stainless steel parts, the means for carrying out the annealing treatment comprising means for heating and means for establishing a pressure condition within the vacuum treatment apparatus, the means for heating and means for establishing a pressure condition are chosen from one of three following groups:

(a) means for maintaining a temperature of at least 500° C. and means for maintaining an $H_2O$ partial pressure of not more than $1\times10^{-5}$ torr;

(b) means for maintaining a temperature of least 400° C. and means for maintaining an $H_2$ partial pressure of at least ten times an $H_2O$ partial pressure; and (c) means for maintaining a temperature of at least 300° C., means for maintaining an $H_2$ partial pressure at least the same as an $H_2O$ partial pressure, and means for activating the $H_2$.

21. The vacuum treatment apparatus of claim 20, wherein the means for establishing a pressure condition comprises one of the following:

a pressure raising part in which $H_2$ which has been absorbed on a very low temperature panel is released by raising the temperature of the panel;

a pressure raising part in which $H_2$ which has been occluded in a solid is released by heating; and a pressure raising part in which an exhaust side pressure of a turbomolecular pump is controlled causing $H_2$ to back diffuse through said turbomolecular pump and thereby raise the $H_2$ partial pressure.

22. The vacuum treatment apparatus of claim 20, further including means for carrying out a baking treatment on the stainless steel parts that removes molecules from the surface without increasing the activation of the surface of the stainless steel parts, the means for carrying out the baking treatment comprising means for heating and means for establishing a pressure condition within the vacuum chamber, the means for heating comprises means for baking the surface at a temperature of at least 100° C.; and the means for establishing a pressure condition comprises one of the following:

means for maintaining an $H_2O$ partial pressure not more than $1\times10^{-5}$ torr;

means for maintaining an $H_2$ partial pressure at least ten times an $H_2O$ partial pressure; and means for maintaining an $H_2$ partial pressure at least the same as an $H_2O$ partial pressure and means for activating the $H_2$.

23. An apparatus for the vacuum treatment of surfaces of stainless steel parts arranged inside a vacuum treatment apparatus comprising:

means for carrying out a baking treatment on the stainless steel parts that removes molecules from the surface without increasing the activation of the surface of the stainless steel parts, the means for carrying out the baking treatment comprising means for heating and means for establishing a pressure condition within the vacuum treatment apparatus, the means for heating comprises means for baking the surface at a temperature of at least 100° C.; and the means for establishing a pressure condition comprises one of the following:

means for maintaining an $H_2O$ partial pressure not more than $1\times10^{-5}$ torr;

means for maintaining an $H_2$ partial pressure at least ten times an $H_2O$ partial pressure; and means for maintaining an $H_2$ partial pressure at least the same as an $H_2O$ partial pressure and means for activating the $H_2$.

24. An apparatus for the vacuum treatment of surfaces of stainless steel parts arranged inside a vacuum treatment apparatus comprising:

means for carrying out a baking treatment on the stainless steel parts that increases activation of the surface of the stainless steel parts, the means for carrying out the baking treatment comprising means for heating and means for establishing a pressure condition within the vacuum treatment apparatus, the means for heating comprises means for baking the surface at a temperature of at least 100° C.; and the means for establishing a pressure condition comprises one of the following:

(a) means for maintaining an $H_2O$ partial pressure at least $1\times10^{-5}$ torr; and (b) means for maintaining an $H_2$ partial pressure not more than an $H_2O$ partial pressure.

* * * * *